United States Patent [19]

Barman et al.

[11] 4,328,547

[45] May 4, 1982

[54] FAILURE SYSTEM FOR INTERNAL COMBUSTION ENGINE

[75] Inventors: Alan W. Barman, Oak Park; Thomas W. Hartford, Livonia, both of Mich.

[73] Assignee: The Bendix Corporation, Southfield, Mich.

[21] Appl. No.: 185,830

[22] Filed: Sep. 10, 1980

Related U.S. Application Data

[62] Division of Ser. No. 881,982, Feb. 27, 1978, Pat. No. 4,264,898.

[51] Int. Cl.[3] ..... F02B 39/16; F02D 33/00

[52] U.S. Cl. ..... 364/431.09; 123/198 DB; 123/480; 364/431.11

[58] Field of Search ..... 364/424, 431; 123/198 D, 198 DB, 480, 486, 493

[56] References Cited

U.S. PATENT DOCUMENTS

| | | | |
|---|---|---|---|
| 3,541,315 | 11/1970 | Naydan et al. | 340/347 AD |
| 3,581,304 | 5/1971 | Paradise | 340/347 AD |
| 3,688,221 | 8/1972 | Truhalf | 340/347 AD |
| 3,750,142 | 7/1973 | Barnes et al. | 340/347 CC |
| 3,858,561 | 1/1975 | Aono | 123/493 X |
| 3,893,432 | 7/1975 | Krupp et al. | 364/431 X |
| 3,961,325 | 6/1976 | Kendall et al. | 340/347 CC |
| 4,094,274 | 6/1978 | Harada et al. | 123/198 DB X |
| 4,099,495 | 7/1978 | Kiencke et al. | 123/480 |
| 4,119,070 | 10/1978 | Asano | 123/198 D X |
| 4,148,283 | 4/1979 | Harada et al. | 123/493 X |
| 4,150,654 | 4/1979 | Heitzman et al. | 123/198 DB |
| 4,174,682 | 11/1979 | Drews et al. | 123/493 X |
| 4,221,191 | 9/1980 | Asano et al. | 123/493 X |

*Primary Examiner*—Felix D. Gruber

*Attorney, Agent, or Firm*—Gaylord P. Haas, Jr.; Russel C. Wells

[57] ABSTRACT

A method and apparatus for controlling the various functions of an internal combustion engine using a program controlled microprocessor having a memory preprogrammed with various control laws and associated control schedules, such as a fuel cut-off and reset system which responds to one of the selected fail signals receives information concerning one or more engine operating parameters such as manifold pressure, throttle position, engine coolant temperature, air temperature, and engine speed or period and the like. These parameters are sensed and then supplied to input circuits for signal conditioning and conversion to digital words usable by the microprocessor. The microprocessor system computes a digital word indicative of a computer-commanded engine control operation and output circuitry responds to predetermined computer-generated commands and to the computed digital command words for converting them to corresponding pulse-width control signals for controlling such engine operations as fuel-injections ignition timing, proportional and/or on-off EGR control, and the like.

6 Claims, 2 Drawing Figures

*Reset Control System*

Microprocessor-Based Electronic Engine Control System

Reset Control System

FAILURE SYSTEM FOR INTERNAL COMBUSTION ENGINE

This application is a division of application Ser. No. 881,982 filed Feb. 27, 1978 and now U.S. Pat. No. 4,264,898.

BACKGROUND OF THE INVENTION

1. Field of the Invention

This invention relates generally to a method and apparatus for controlling an internal combustion engine and more particularly to a microprocessor-based electronic engine control system having a memory preprogrammed with various control laws and control schedules responsive to one or more sensed engine-operating parameters and generating control signals for fuel injection, ignition timing, EGR control, and the like.

2. Statement of the Prior Art

Many of the patents of the prior art recognize the need for employing the enhanced accuracy of digital control systems for more accurately controlling one or more functions of an internal combustion engine.

U.S. Pat. No. 3,969,614 which issued to David F. Moyer, et al on July 13, 1976 is typical of such systems as are U.S. Pat. No. 3,835,819 which issued to Robert L. Anderson, Jr. on Sept. 17, 1974; U.S. Pat. No. 3,904,856 which issued to Louis Monptit on Sept. 9, 1975 and U.S. Pat. No. 3,906,207 which issued to Jean-Pierre Rivere, et al on Sept. 16, 1975. All of these Patents represent a break-away from the purely analog control systems of the past, but neither the accuracy, reliability, or number of functions controlled is sufficient to meet present day requirements.

Future internal combustion engines will require that emissions be tightly controlled while due to ever-increasing governmental regulations, while fuel consumption is minimized and drivability improved over the entire operating range of the engine. None of the systems of the prior art provide a method and apparatus for controlling the operation of an internal combustion engine with sufficient accuracy to attain minimal emissions and minimal fuel consumption together with improved drivability.

The systems of the prior art attempt to control one or more of the engine operating functions but none attempts to control the operation of the fuel pump, fuel injection, engine ignition timing on-off and/or proportional EGR control, and the like while using feedback from such devices as oxygen sensors for emission control purposes or for effecting a closed loop fuel control operations, and yet including provisions for optimizing acceleration enrichment handling, and the like. Moreover, the systems of the prior art are extremely expensive, difficult to repair and maintain and are, therefore, not commercially feasible at the present time.

These and other problems of the prior art are solved by the microprocessor-based electronic engine control system of the present invention which eliminates most or all of the problems of the prior arts and enables a commercially feasible implementation of a digital control system having a relatively low cost, and which is easy to repair and maintain. The system of the present invention is able to implement much more advanced and complex fuel control laws and expand the various control functions performed thereby to include ignition timing and on-off and/or proportional EGR control while, at the same time, reducing the cost and size of the unit and increasing reliability so as to render the system commercially feasible.

Another problem existing in the prior art is that electronically controlled fuel systems are subject to failure and a failure could conceivably occur in which a fuel injection pulse were left on so that fuel continued to be injected or supplied to the engine even after some catastrophic failure. The present invention also supplies means for automatic fuel shut-off upon the detection of a failure in the system.

SUMMARY OF THE INVENTION

The fuel shut-off circuit for the electronic engine control system of the present invention includes means for detecting one or more of a plurality of failures such as termination of the operation of the systems clock, an engine stall condition, or the like and generate a fail detect signal in response thereto. Getting means responsive to said fail detect circuit terminates the transmission of the normally generated fuel control pulses to said means for supplying fuel to said engine. Additionally, means may be added directly responsive to the generation of said fail detect signal for turning off the fuel pump itself.

INCORPORATION BY REFERENCE

This application is a division of Ser. No. 881,982, now U.S. Pat. No. 4,264,898, which in turn is one of fourteen applications filed on Feb. 27, 1978, all commonly assigned and having substantially the same specification and drawings, the fourteen applications being identified below:

| Serial Number | Title |
|---|---|
| 881,321 | Microprocessor-Based Electronic Engine Control System |
| 881,322 | Feedback-Compensated Ramp-Type Analog to Digital Converter |
| 881,323 | Input/Output Electronic For Microprocessor-Based Engine Control System |
| 881,324 | Switching Control of Solenoid Current in Fuel Injection Systems |
| 881,921 | Dual Voltage Regulator With Low Voltage Shutdown |
| 881,922 | Oxygen Sensor Qualifier |
| 881,923 | Ratiometric Self-Correcting Single Ramp Analog To Pulse Width Modulator |
| 881,924 | Microprocessor-Based Engine Control System Acceleration Enrichment Control |
| 881,925 | Improvements in Microprocessor-Based Engine Control Systems |
| 881,981 | Oxygen Sensor Feedback Loop Digital Electronic Signal Integrator for Internal Combustion Engine Control |
| 881,982 | Improvements in Electronic Engine Controls System |
| 881,983 | Electronic Fuel Injection Compensation |
| 881,984 | Ignition Limp Home Circuit For Electronic Engine Control Systems |
| 881,985 | Oxygen Sensor Signal Conditioner |

Figure 2:
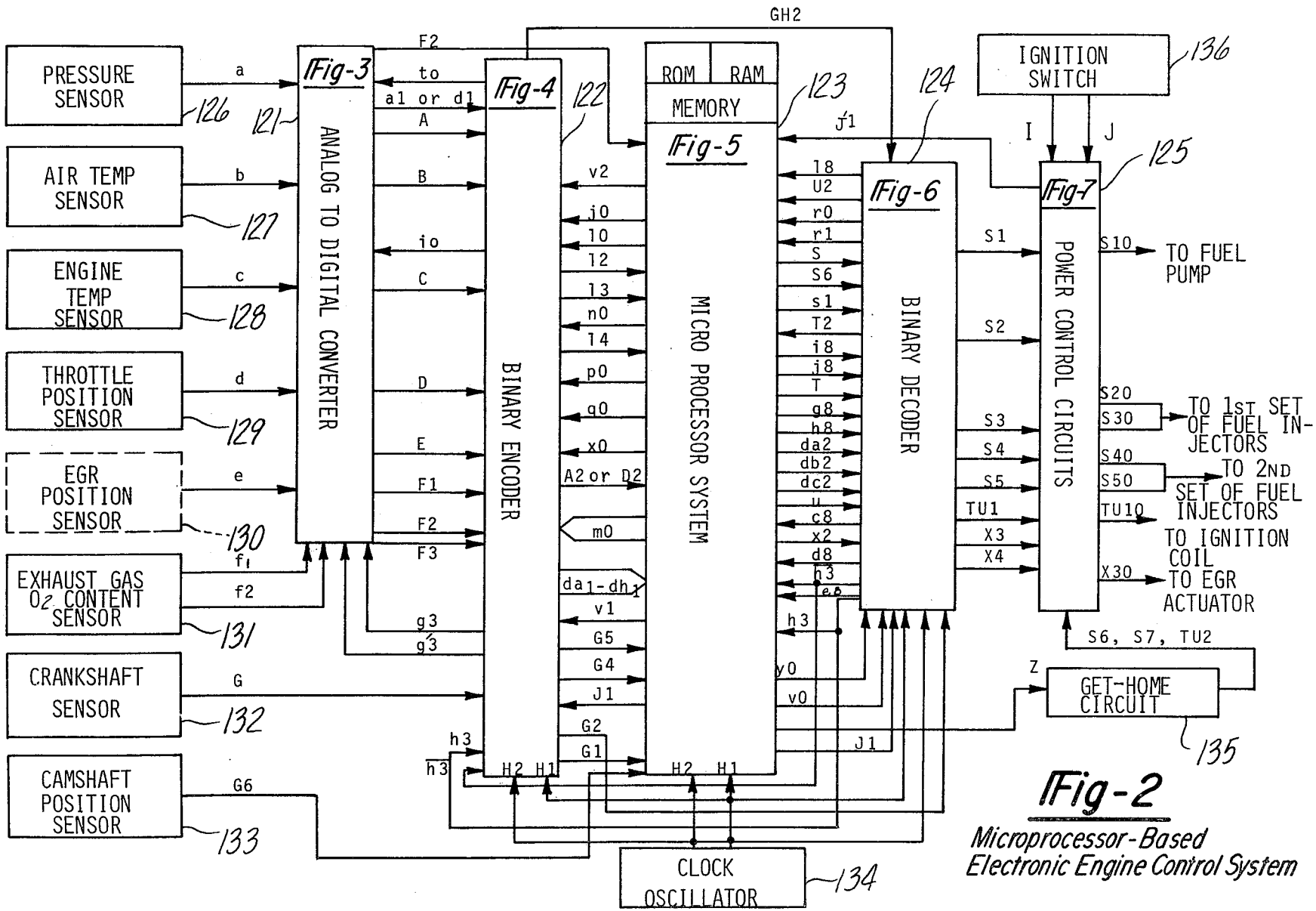
FIG. 2 is a block diagram of the microprocessor-based electronic engine control system.
Figure 5A:
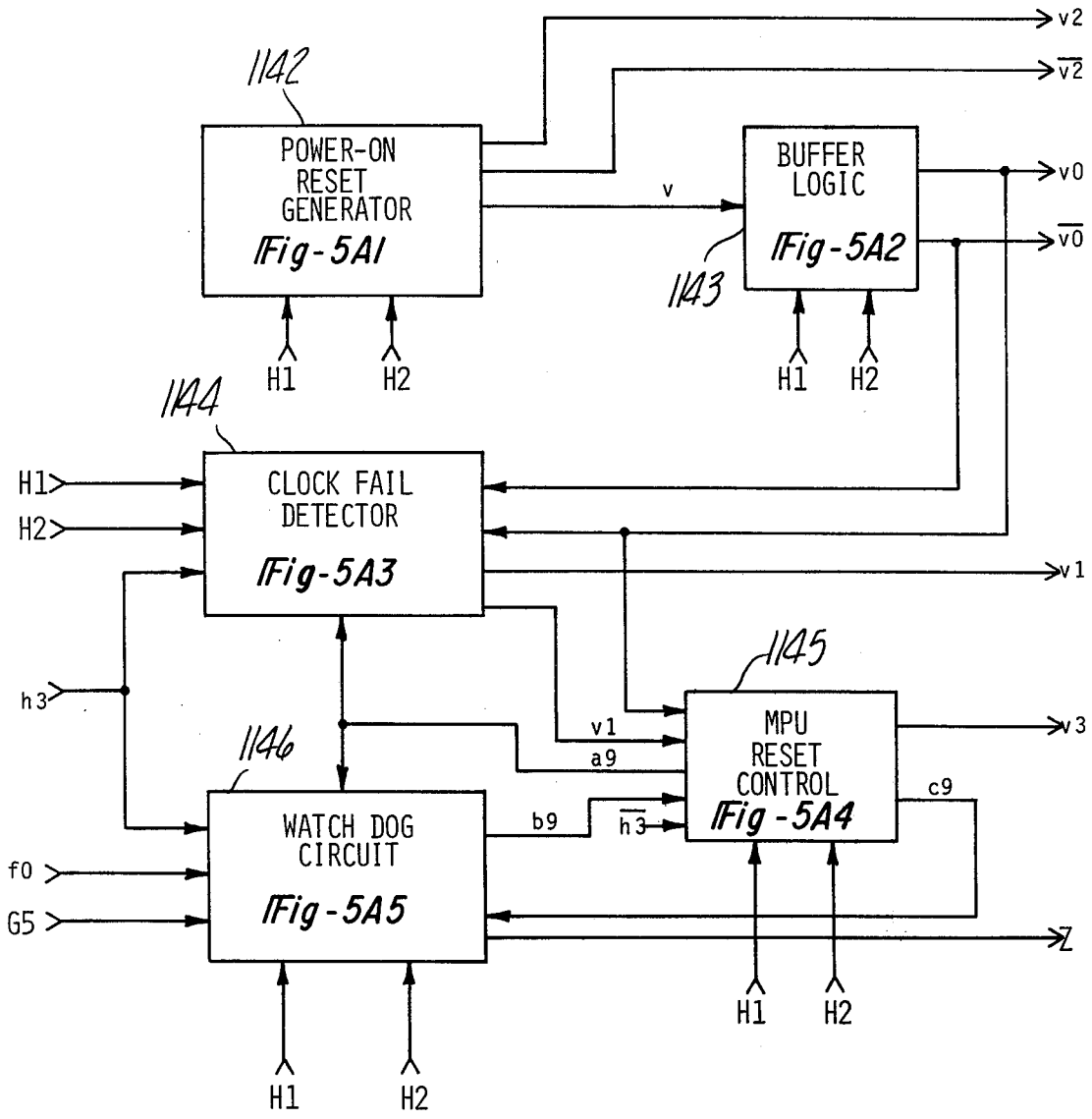
FIG. 5A is a block diagram of the reset control circuitry.

Application Ser. No. 881,321, now U.S. Pat. No. 4,255,789, has been printed in its entirety, including FIGS. 1 to 10.34 and the specification of that application is specifically incorporated by reference.

Having thus described the invention, what is claimed is:

1. In an internal combustion engine having an intake system, an exhaust system, and engine block, a plurality of cylinders disposed in said engine block, a piston mounted for reciprocal movement within each of said plurality of cylinders, means responsive to a fuel control signal for injecting a controlled quantity of fuel into a selected one or more of said plurality of cylinders, fuel pump means for normally supplying fuel to said fuel injecting means, electronic engine control means responsive to one or more engine-operating parameters for computing said fuel control signal, the improvement comprising:

means for detecting at least one of a systems clock failure and a stall condition and for generating a fail signal in response to the occurrence of only one of said clock failure or stall condition;

means responsive to said generated fail signal for shutting off said fuel pump means and terminating the transmission of said computed fuel control signal to said fuel injecting means; and means for defeating said responsive means in response to the simultaneous occurrence of said systems clock failure and said stall condition.

2. A fuel shut-off circuit for an electronic engine controller, a means of fuel supply, said electronic engine controller normally supplying fuel control signals for controlling the means of fuel supply to an engine, said fuel shut-off circuit comprising means for detecting not more than one of a data clock failure condition and an engine stall condition and generating a "fail" signal indicative of only one of said conditions, and means responsive to said "fail" signal for terminating the transmission of said fuel control signals to said means for supplying fuel to said engine.

3. A double protection fuel shut-off system for internal combustion engine vehicles having an engine block, a plurality of cylinders disposed within said engine block, a piston mounted for reciprocal movement within each of said plurality of cylinders, an electronic engine control system for generating at least one fuel control pulse, fuel injection means responsive to said at least one fuel control pulse generated by an electronic engine control system for injecting controlled quantities of fuel into selected ones of said plurality of cylinders for combustion therein, fuel pump means for supplying fuel under pressure to said fuel injection means, said electronic engine control system further including clock means utilized in initializing the performance of calculations and the like for computing fuel control commands, and means responsive to said fuel control commands for generating said fuel control pulses for operating said fuel injection means, said fuel shut-off system comprising:

logic means for monitoring the operations of said clock means and generating a clock failure signal indicative of a detected malfunction therein;

means for sensing an engine stall condition when said engine is not in a "cranking" mode of operation and for generating a stall condition signal indicative thereof; and means responsive to only one of said clock failure signal and said engine stall condition signal for generating a signal substantially simultaneously turning off said fuel pump means to prevent the flow of fuel to said fuel injection means while disabling said fuel control pulses from operating said fuel injection means thereby affording the driver, the passengers and the vehicle itself optimal protection from fire, explosion in case of accidents, said responsive means being inhibited from generating said turn-off signal when said clock failure signal and stall condition signal exist simultaneously.

4. The double protection fuel shut-off system of claim 3 wherein said logic means for monitoring the operation of said clock means further includes means responsive to the detection of a first clock failure for resetting said electronic engine control system to give said clock means a second chance but being responsive to the detection of the second malfunction in said clock means within a predetermined lapsed period for generating said clock fail signal.

5. The double protection fuel shut-off system of claim 3 wherein said electronic engine control system further includes computer means, memory means associated with said computer means, program means stored within said memory means for implementing one or more control laws and the like, said program means being executed by said computer means for calculating a digital command word and wherein said system further includes means responsive to a particular one of said calculated digital command words for shutting off said fuel pump means under program control.

6. The double protection fuel shut-off system of claim 3 wherein said means for sensing an engine stall condition includes means for storing a signal having a first state to indicate the existence of a "stall" condition and an opposite state to indicate the absence of a "stall" condition, means responsive to state of said stored signal for generating said stall condition to operate said shut-off means, sensor means associated with said engine for generating engine position pulses indicative of the speed thereof, counter means normally reset by successive engine position pulses for counting clock pulses and for generating an overflow signal whenever said counter reaches its maximum count before the arrival of the next subsequent engine position pulse indicating that a "stall" condition exists, said means for storing said signal being responsive to said overflow signal from said counter means for setting said stored signal in said first state to indicate a "stall" condition when an overflow occurs and for setting said stored signal in said second state when no overflow condition exists.

* * * * *